US006693598B1

(12) United States Patent
Bishop et al.

(10) Patent No.: US 6,693,598 B1
(45) Date of Patent: Feb. 17, 2004

(54) OMNI DIRECTIONAL ANTENNA WITH MULTIPLE POLARIZATIONS

(75) Inventors: Bruce Bishop, Aptos, CA (US); Matthew H. Commens, Morgan Hill, CA (US); Patrick McKivergan, Scotts Valley, CA (US); Kevin Ketelsen, Capitola, CA (US); Ben Newman, Santa Cruz, CA (US); Michael A. Kauffman, Palo Alto, CA (US); Jerry Hovey, Santa Cruz, CA (US)

(73) Assignee: Tyco Electronics Logistics AG (SE)

( * ) Notice: Subject to any disclaimer, the term of this patent is extended or adjusted under 35 U.S.C. 154(b) by 0 days.

(21) Appl. No.: 09/675,774

(22) Filed: Sep. 27, 2000

(51) Int. Cl.[7] ..... H01Q 1/24; H01Q 11/12
(52) U.S. Cl. ..... 343/741; 343/702; 343/866
(58) Field of Search ..... 343/741, 866, 343/702, 700 MS, 846; H01Q 1/24, 11/12

(56) References Cited

U.S. PATENT DOCUMENTS 5,181,044 A * 1/1993 Matsumoto et al. ..... 343/752
5,583,523 A * 12/1996 Wallace, Jr. ..... 343/741
5,847,683 A 12/1998 Wolfe et al. ..... 343/866
5,943,020 A 8/1999 Liebendoerfer et al. .... 343/702
5,945,959 A * 8/1999 Tanidokoro et al. ..... 343/728
5,969,681 A 10/1999 O'Neill, Jr. ..... 343/700
5,977,921 A 11/1999 Niccolai et al. ..... 343/741
6,034,636 A 3/2000 Saitoh ..... 343/700
6,166,694 A * 12/2000 Ying ..... 343/702
6,188,371 B1 2/2001 Li et al. ..... 343/866
6,236,368 B1 * 5/2001 Johnson ..... 343/702
6,239,753 B1 5/2001 Kado et al. ..... 343/702
6,243,045 B1 6/2001 Ishibashi ..... 343/741
6,255,994 B1 7/2001 Saito ..... 343/700
6,271,796 B1 * 8/2001 Itoh et al. ..... 343/702
6,292,152 B1 9/2001 Cosenza et al. ..... 343/745
6,326,924 B1 * 12/2001 Muramoto et al. ..... 343/702

* cited by examiner

*Primary Examiner*—Hoanganh Le
(74) *Attorney, Agent, or Firm*—Fulbright & Jaworski L.L.P.

(57) ABSTRACT

An omni-directional antenna assembly is provided for wireless communication devices requiring multiple polarization characteristics. A loop antenna assembly for a communications device operating at a predetermined wavelength and having a transceiver circuit including a signal output and a ground plane, the antenna assembly including a conductive loop element and a conductive leg member coupled to the loop element proximate a loop perimeter, the leg member for supporting the loop element at a distance away from the ground plane of the communications device, the leg member also defining a ground point and a feed point for operatively coupling the loop element to the ground plane and the signal output, respectively, of the transceiver circuit.

23 Claims, 12 Drawing Sheets

OMNI DIRECTIONAL ANTENNA WITH MULTIPLE POLARIZATIONS

FIELD OF THE INVENTION

This invention relates generally to antenna structures for wireless communications devices, and more particularly to compact, high efficiency, electrically small loop antennas for use in portable communication devices.

BACKGROUND OF THE INVENTION

The physical size of modem compact communication devices often is dictated by the size of the antenna needed to make them function effectively. To avoid devices that are too large, pagers have made use of electrically small rectangular loop (1/10 wavelength). However, these small antennae tend to be inefficient as a result of their very low radiation resistance and comparatively high resistive loss. Likewise, as a result of their high Q they tend to be sensitive to their physical environment.

To overcome the disadvantages of electrically small loop antennas, there is a continuing need for antennas small in physical dimension; having relatively high efficiency; capable of being placed in close proximity to associated electronic circuits without adversely effecting performance; easy to manufacture using standard, low-cost components; and capable of having radiation patterns altered to support different applications.

This patent application further concerns a circular polarization antenna for left hand and right hand polarization. Circular polarization is typical of satellite systems, such as the Global Positioning System (GPS). This field is in rapid expansion due to the vast range of possible applications and the relative low cost of implementing these systems.

The fixed and mobile land devices associated with such systems have required more specialized antennas designed to perform specific functions effectively. Two types of antennas have to date been used in circular polarization communication and navigation systems on mobile devices: the first is the "helix" or helicoidal antenna, while the second is known as the "patch" antenna.

In helicoidal antennas, circular polarization is obtained by exciting a progressive wave on a helicoidal wire; the direction of the circular polarization (left or right) is determined by the sense of helicoidal wire winding.

The helicoidal antennas have the advantage of being very simple to design and produce and have a considerable band width which ensures high sensitivity; this characteristic of the helicoidal antenna makes the tolerance range wider, making it possible to use inexpensive materials which are easy to obtain on the market. This type of antenna has the added advantage of having a good gain value in an axial direction with an equally good axial ratio that, as the experts in the field know, is the most important reference parameter for the quality of circular polarization.

The disadvantage of helicoidal antennas is their by no means negligible height which makes them inconvenient for certain applications, such as installation on vehicles or hand-held devices where low profile antennas are required, obviously because they must be streamlined.

The low profile is the main characteristic of the second type of antenna mentioned above, known as the patch antenna, where circular polarization is obtained by exciting a resonant current distribution on a planar conducting surface. The direction of circular polarization is determined by a precise calculation of the position of the "point of excitation" of the surface.

This type of antenna, however, requires the use of relatively expensive materials, and, above all great precision during setting up and production due to the small tolerances to respect.

Considering the above state-of-the-art, another type of circular polarization two-way antenna was designed with the aim of offering all the advantages of both of the above antennas, without the disadvantages or application limitations of either.

SUMMARY OF THE INVENTION

An omni-directional antenna which includes a conductive loop element supported above a conductive ground plane of a wireless communication device by a conductive leg member. The conductive leg member further defines a feedpoint at which the antenna is operatively coupled to the device's signal generating circuitry. A dielectric element may optionally be disposed between the loop and ground plane.

The improved antenna displays gain in both the vertical and horizontal orientations. The horizontal gain is due to currents in the loop. The vertical gain (perpendicular to the loop and the ground plane) is due to displacement current fields within the conductive leg member disposed between the loop and the ground plane.

Circular polarization is obtained by exciting a wave along a loop wire. The loop defines a closed path, which need not necessarily be a circular path. An antenna including a rectangularly defined loop is also disclosed herein. Different approaches may be utilized to effect wave polarization (left-hand or right-hand); the first consists in exciting the loop wire at two separate points staggered at an angle of 90 degrees with respect to the center of the loop wire and providing a source in phase quadrature. Alternatively, the loop wire may be excited at only one point by discriminating one of the two polarizations by means of a passive probe, a directional probe or other suitable means.

The operational frequency band of the antenna is largely determined by the outside circumference dimension of the conductive loop. The outer circumference dimension is substantially equivalent to ½ of the wavelength of the frequency of response. Thus the system performs similarly to a ½ wave slot antenna. Tuning of the antenna can be accomplished by adjusting the feed network. Adjusting the width and location of the conductive leg member will transition the frequency and impedance.

Another feature of embodiments of the present invention is a notch element in the conductive leg member. Changes in the notch height can be used to adjust the antenna match. Further tuning can be accomplished by adjusting the width of the ring. As the ring is made wider, the operational frequency range becomes higher.

One advantage of the invention is that the antenna performance is largely independent of the dimensions of the ground plane. Thus the antenna can be readily adapted to different devices having various ground plane dimensions.

The above and other objects and advantageous features of the present invention will be made apparent from the following description with reference to the accompanying drawings, in which like reference characters designate the same or similar parts throughout the drawings.

DETAILED DESCRIPTION OF PREFERRED EMBODIMENTS

Figure 1:
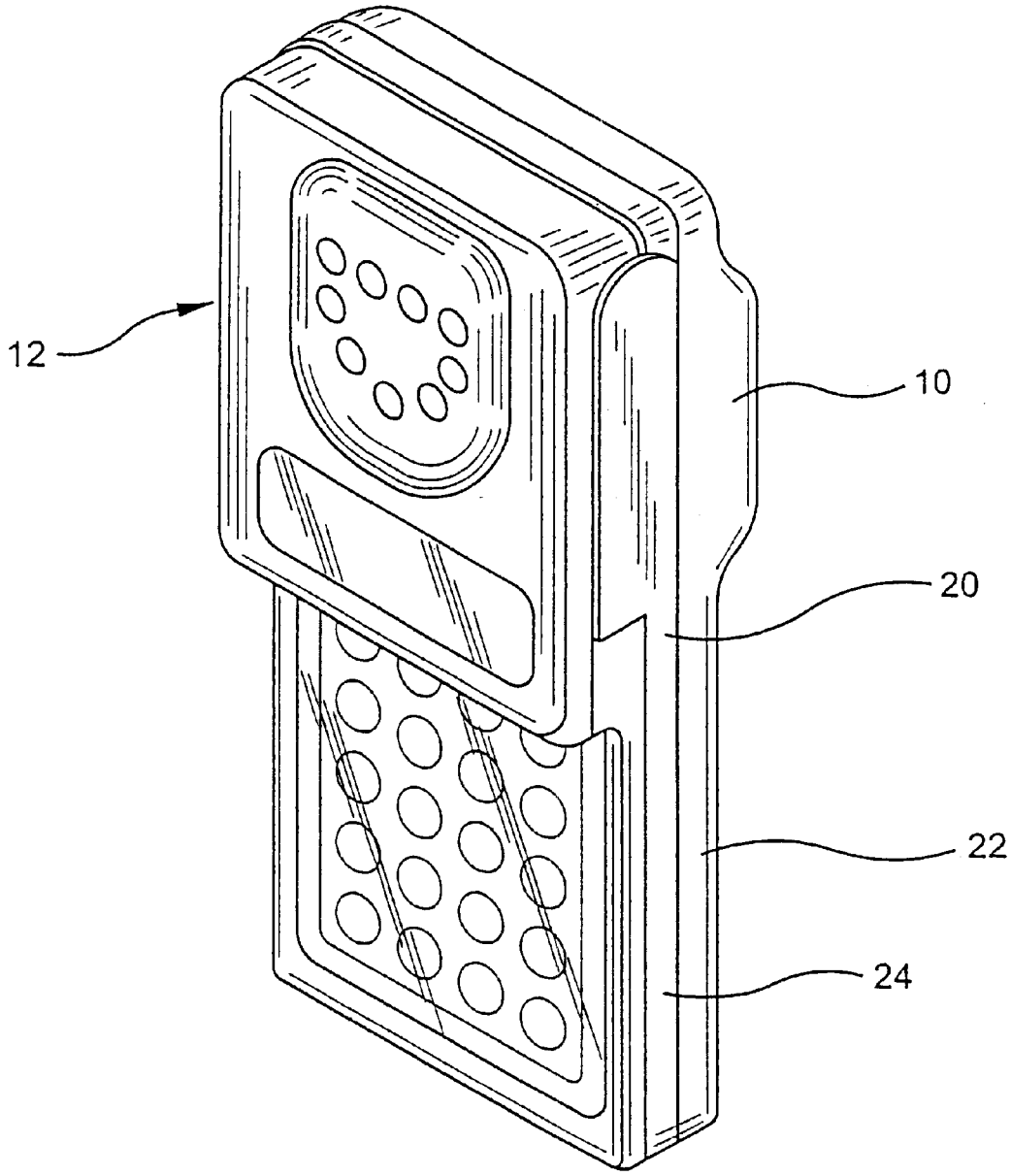
FIG. 1 shows a perspective view of a wireless communications device utilizing an antenna according to the present invention.
Figure 2:
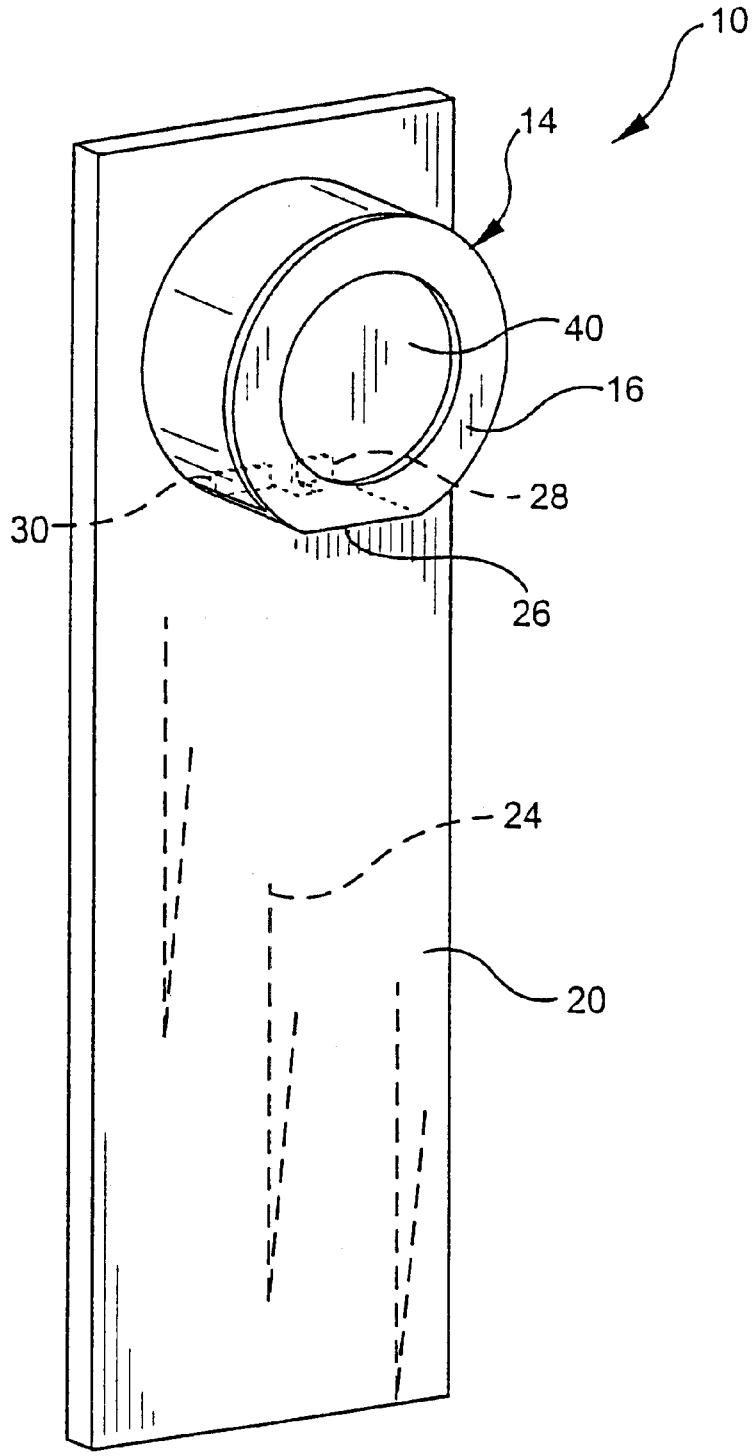
FIG. 2 is a perspective view of a portion of the wireless communications device of FIG. 1, illustrating the ground plane element and the loop element of the antenna assembly.

FIG. 1 illustrates an antenna assembly 10 disposed within a wireless communications device 12, such as a cellular telephone or PDA device. The antenna assembly 10 includes a circular loop resonator element 14 defining a loop surface 16 disposed away from a ground plane element 20. In preferred embodiments, the antenna assembly 12 can be implemented to transmit and receive on desired frequencies, including analog or digital U.S. or European cell phone bands, PCS cell phone bands, 2.4 GHz BLUETOOTH™ bands, or other frequency bands as would be obvious to one skilled in the art.

The antenna assembly 10 is disposed near the upper portion of the device 12 (away from the user's hand during operation), and is received and incorporated within the housing 22 of the device 12. Although the antenna assembly 10 can be installed in locations within or external to the housing 22, it is presently preferred that it be disposed within the housing 22. Wireless communication device 12 contains an electronic device, such as a receiver and/or transmitter herein referred for convenience together as a transceiver component 24.

Referring now to FIGS. 2–7, the loop surface 16 of the circular loop resonator element 14 is disposed in substantially parallel relationship to the ground plane element 20. Ground plane 20 is illustrated herein as a substantially rectangular form. It should be recognized that ground plane 20 may assume alternative shapes or forms, provided that at least one major dimension is approximately ¼ wavelength long at the lowest frequency of operation. A conductive leg element 26 is contiguous with and extends from an edge of the loop surface 16 toward the ground plane element and defines a feed tab 28 for the antenna assembly 12. The feed tab 28 is operatively coupled to the transceiver signal input/output component 24, such as via a coax line 25 of FIG. 5. The conductive leg element 26 further defines a ground tab 30 for coupling the leg element 26 to a circuit ground. Loop resonator 14 is thus electrically connected to the ground plane 20 via the ground tab 30. A slot 32 is defined between the feed tab 28 and the ground tab 30 of the conductive leg element 26. The dimensions of the loop resonator element 14 may be varied to conform to a portion of the housing 22. Those skilled in the arts will appreciate that the design and selection of the loop resonator element 14 with reference to a particular wireless communication device may result in such complex shapes.

In the embodiment of FIGS. 2–7, a disk-shaped dielectric element 40 is disposed between the conductive loop resonator element 14 and the ground plane 20. The dielectric element 40 may include a glass filled polymer such as ULTEM 1000 (available from Boedeker Plastics, Inc. of Shiner, Tex.) for the dielectric disk. This material is a glass filled polymer which has a dielectric constant of approximately 3.15. This dielectric material is suitable for the antenna 10 to be surface mounted through a thermal reflow solder process. Other dielectric materials can be used as well. Those skilled in the relevant art will appreciate that selection of a dielectric material having a higher dielectric constant can result in a smaller, more compact, antenna 10. Dielectric constant values are preferably in the range from 1 to 35. The selection of dielectric materials should include considerations including high temperature resistance, and low loss factor for antenna performance. Other dielectric materials which may be suitable include ceramic materials, and aerogels. Ceramic filled plastics can also be used, such as TMM material manufactured by Rogers Corporation, of Chandler, Ariz., which is available in dielectric constant values from 3 to 10, and which is resistant to solder reflow temperatures. TMM material consists of a hydrocarbon thermoset plastic (ceramic-filled) that provides a tight control of dielectric constant, low loss, and excellent temperature stability.

Figure 6:
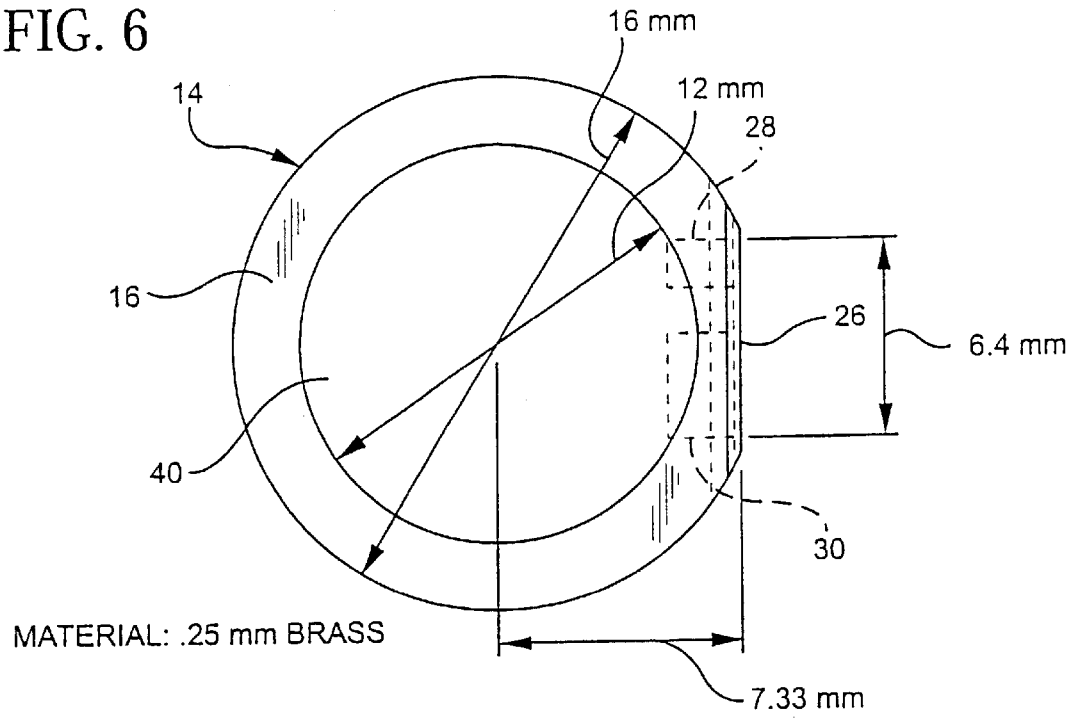
FIG. 6 is a top plan view of one preferred embodiment of the loop antenna assembly according to the present invention.
Figure 7:
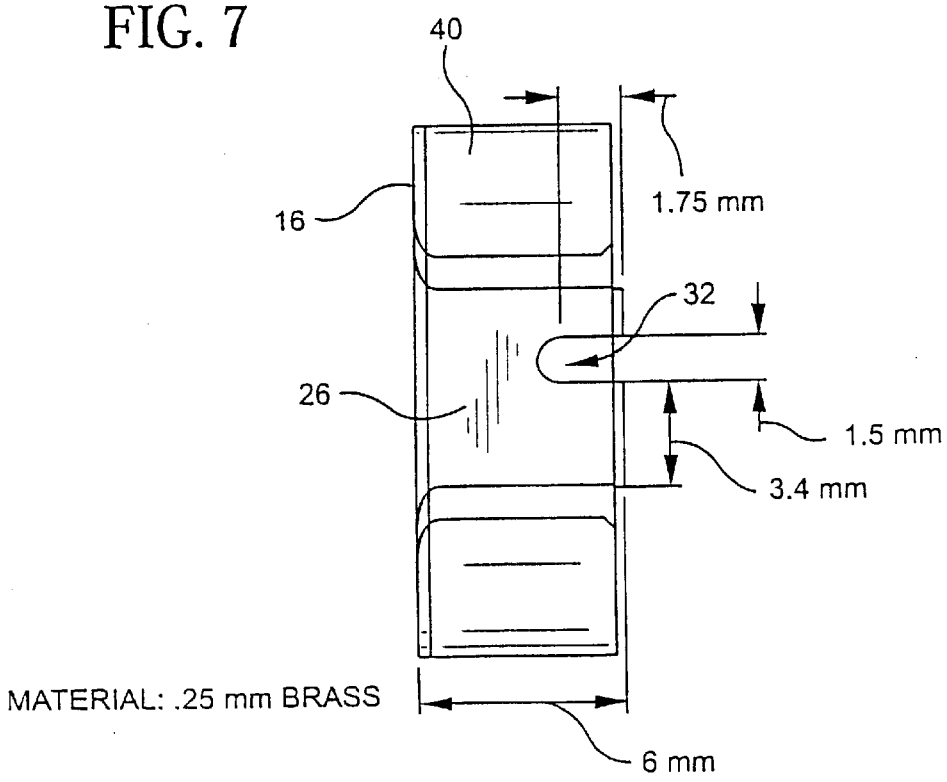
FIG. 7 is a side elevational view of the preferred embodiment of FIG. 6.

The conductive loop resonator element 14 and leg element 26 can be integrally manufactured from a single conductive metal or other suitable conductive material. In one embodiment, as illustrated in FIGS. 6 and 7, the conductive metal would be 0.25 mm thick brass for operation about the 2.4–2.5 GHz frequency range. The conductive members 14, 26 can be shaped by stamping, milling, plating or other suitable method as would be obvious to one skilled in the relevant arts. The conductive members 14, 26 may also be overmolded with a polymeric dielectric 40, or mechanically secured onto the dielectric member 40. In another embodiment (not shown), the conductive members 14, 26 may be selectively plated onto the dielectric member 40 using electrolytic or electroless or other suitable methods. One particular method would employ the MID technology of two shot molding followed by electroless plating. In another embodiment the manufacturing method may employ insert molding over the existing conductive portion.

The loop resonator element 14 can be soldered onto the wiring board of the communication device 12 for electrical and mechanical coupling of the feed tab 28 to the signal transceiver component 24, and the ground tab 30 to the ground portion of the transceiver component 24. Alternatively, a microstrip feedline (not shown) from the communication device 12 to the antenna 10 can also be employed.

Figure 3:
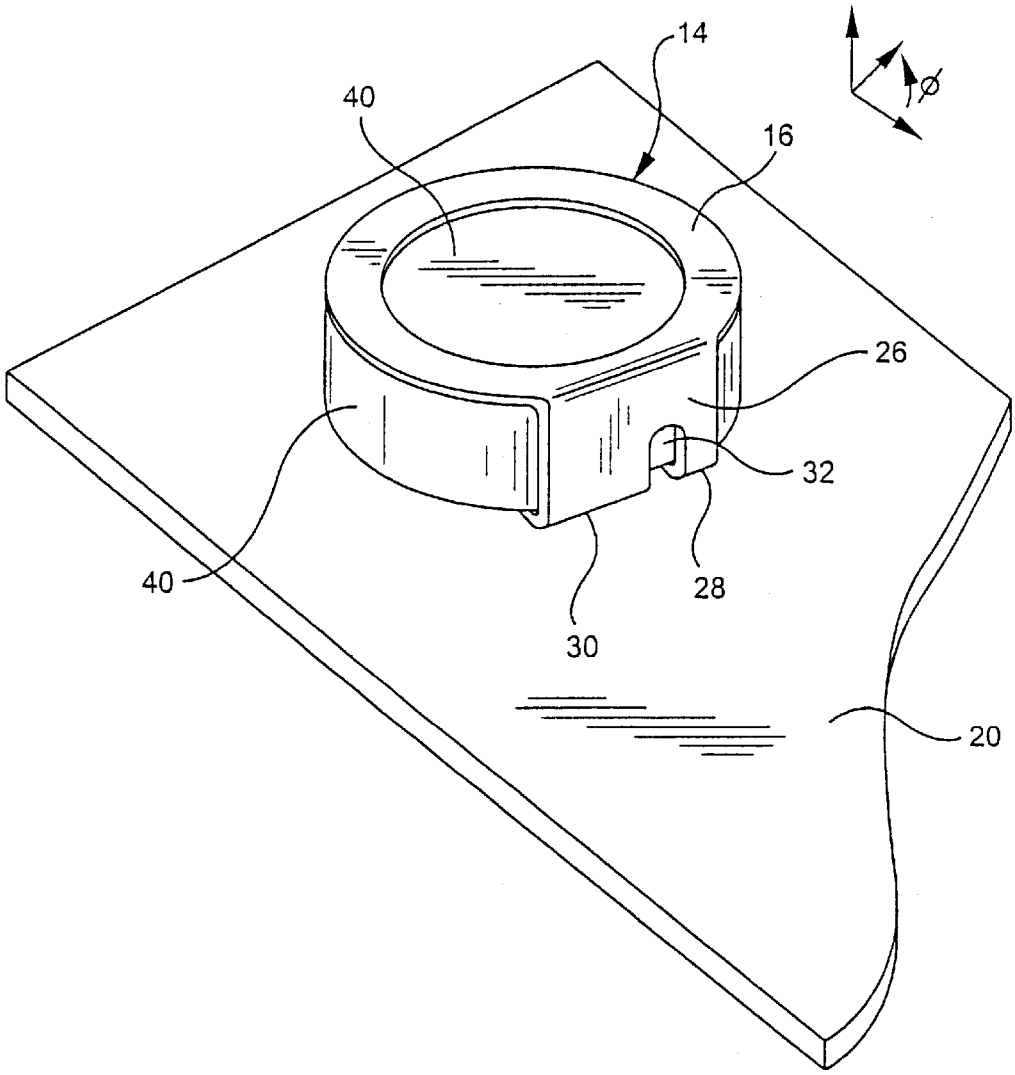
FIG. 3 is another perspective view of a portion of the wireless communications device of FIG. 1, illustrating the ground plane element and the loop element of the antenna assembly.
Figure 8:
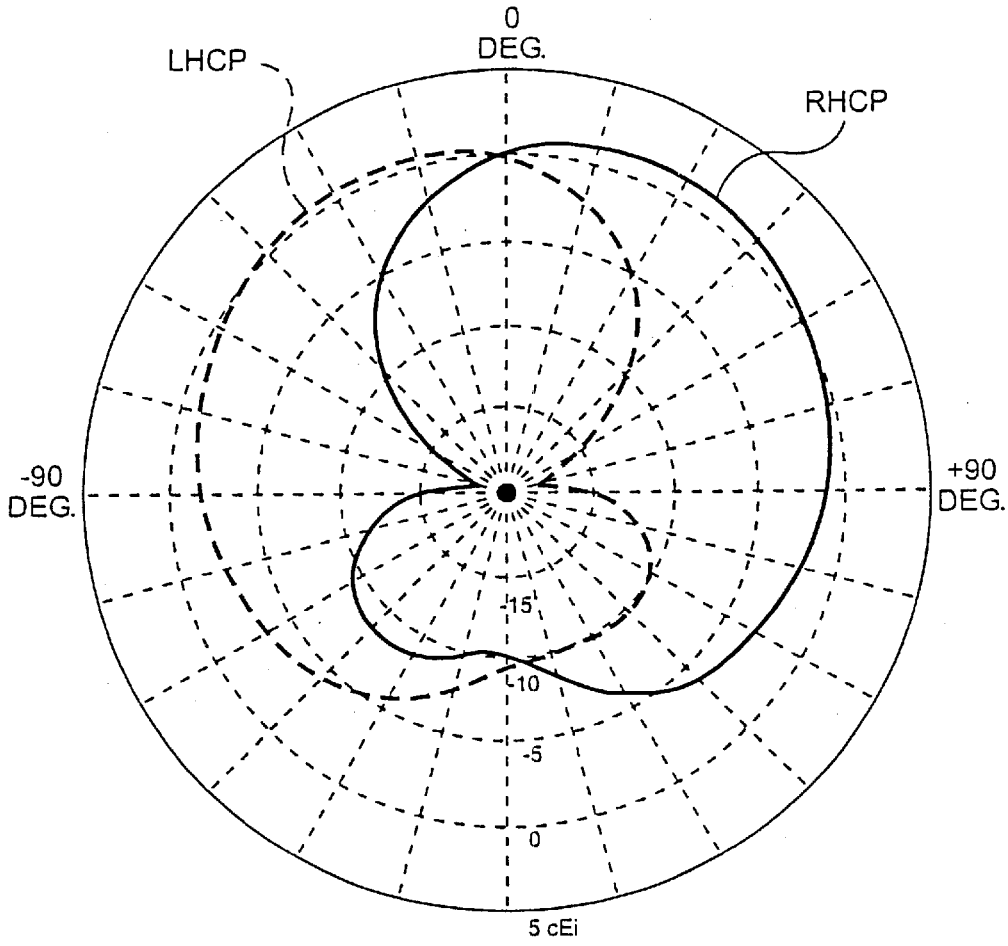
FIG. 8 is a polar chart of gain characteristics of an antenna assembly of FIG. 6.

A primary advantage of this invention is that multiple polarizations can be obtained from a very compact design. As illustrated in FIG. 8, the unit produces right hand and left hand circular polarizations as well as vertical and horizontal responses. With reference to FIG. 3, the right hand side of the antenna 10 transmits and receives right hand circular polarized radiation, while the left side of the antenna 10 transmits and receives left hand circular polarized radiation. The antenna 10 also transmits and receives vertical polarization in the azimuthal direction which is nearly perfectly omni-directional, and horizontal polarization at zenith.

As a result, the antenna 10 is particularly well suited for GPS usage at 1.575 MHz due to the right hand circular polarization response. The antenna 10 can also be built scaled in size to perform in the BLUETOOTH™ frequency band, at 2.4 GHz. This antenna 10 is also well suited for BLUETOOTH™ and ISM applications since the multiple dimensions of polarization performance allow the unit to be oriented in many angles of configuration and still have good response. Thus the antenna 10 can be used in a handheld device 12 which can be carried in any orientation and still provide acceptable signal transmission and reception quality.

Figure 4:
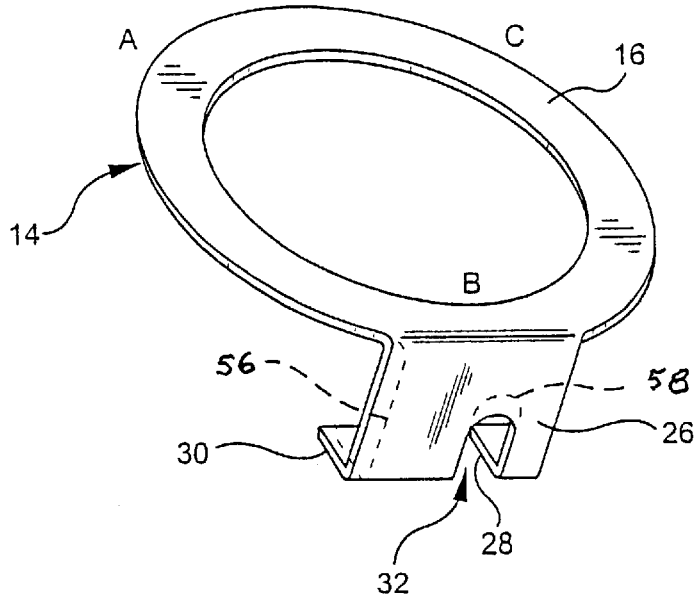
FIG. 4 is a perspective view of the loop element of the antenna assembly of FIG. 3.
Figure 5:
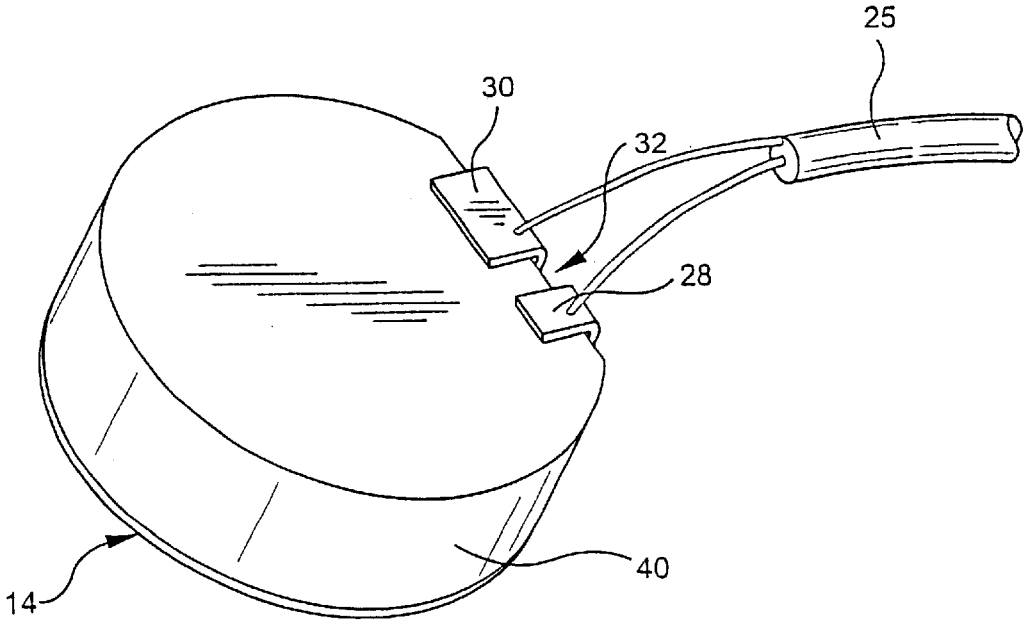
FIG. 5 is another perspective view of the loop element of the antenna assembly of FIG. 3.

Referring again to FIG. 8, it has been determined that the antenna has both a right hand and left hand CP component at Ø=90° and −90° respectively. The antenna 10 can be considered as a ½ wave loop antenna with an electrical distance around the ring of ½ wavelength at 2.45 GHz. Describing the antenna 10 in this manner leads to the definition of points about the ring corresponding to distances along the wavelength. In FIG. 4 the 0, ¼ and ½ wavepoints are indicated by A, B and C respectively.

Figure 9:
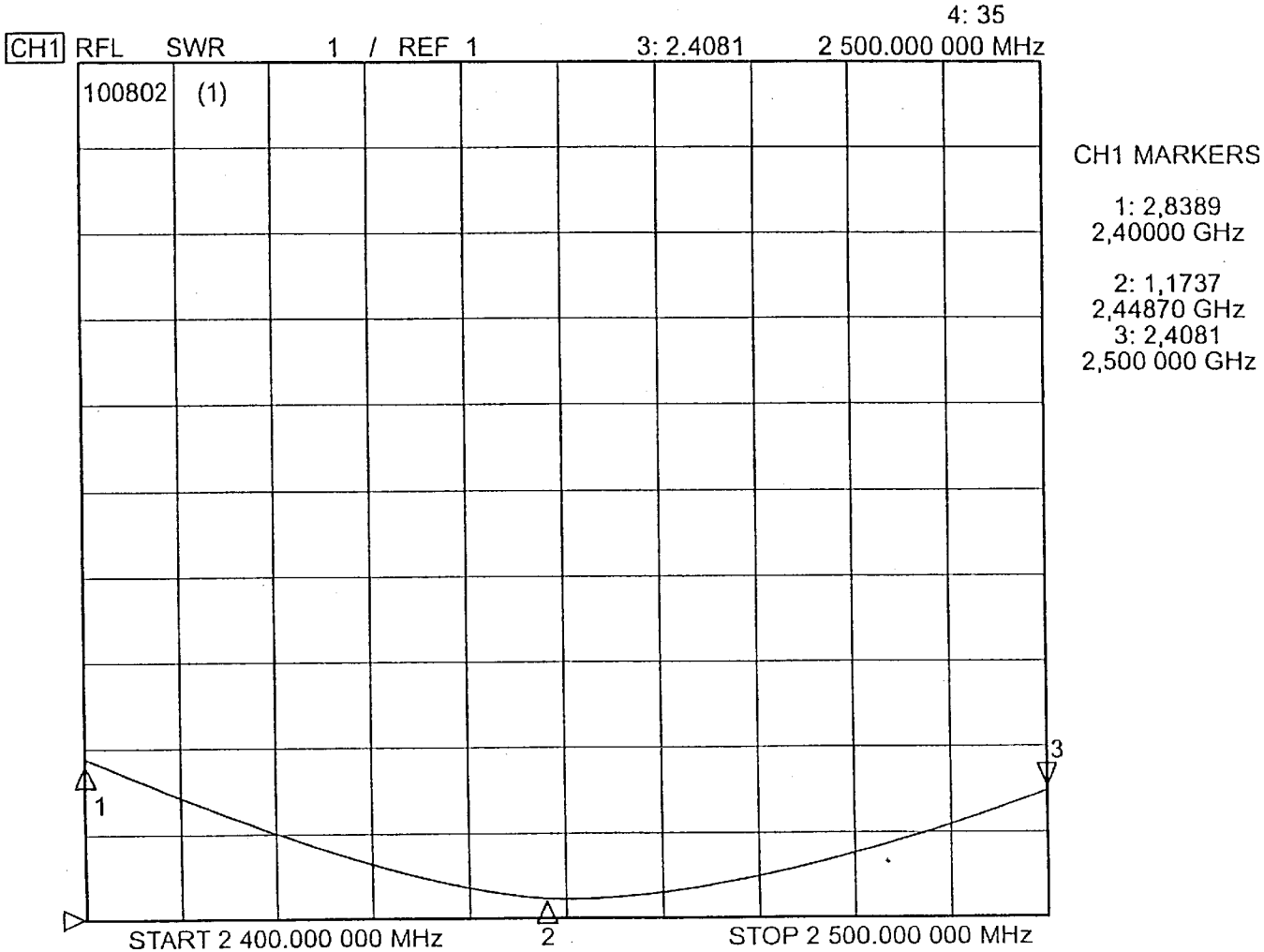
FIG. 9 is a VWSR vs. frequency plot of the antenna of FIG. 6.

At resonance, a current standing wave (CSW) is set up around the ring 16 with current max at A and C and a current null at B. In addition, a voltage standing wave (VSW), phase shifted 90°, is established between the ring 16 and the groundplane 20. The VSW has voltage nulls at A and C and a max at B. The conduction current of the CSW produces a horizontally polarized E-field and the displacement current from the VSW produces a vertically polarized E-field. Circular polarization requires a 90° phase shift between polarizations, which is inherent in this design. As a second requirement for circular polarization, the E-fields from the two polarizations must be equal in magnitude. This second requirement does not occur at any of the locations on the ring having either a current or a voltage null (0,¼ and ½ wave points). However, between these locations, including possibly the ⅛ or ⅜ wave points, it may occur that the magnitude of the E-field components are approximately equal. In addition, the antenna assembly 10 may display right- and left-hand circular polarization responses at Ø=90° and −90° respectively, near the ⅛ and ⅜ wavelength points. FIG. 9 illustrates the voltage standing wave ratio (VWSR) vs. frequency plot for the antenna of FIGS. 6–7.

Minor tuning adjustments may be necessary upon integration of the antenna assembly 19 into the wireless device 12. Two dimensions on the antenna 10 can be adjusted to tune the antenna 10 into the desired operational band. To tune the antenna 10 to a lower frequency, material can be removed from the left side of the conductive leg element 26 and ground tab 30 as shown in FIG. 4 as phantom lines 56. Changes should be of the order of 0.25 mm to change the resonance frequency by 25 MHz. These numbers are not exact but do give an order of magnitude. This removal of the material makes the slot longer and thereby lowers the frequency. To adjust the match to a higher impedance the slot between the leg element 26 and ground tab 30 and the feed tab 26 should be lengthened (as indicated by phantom line 58 in FIG. 4). Relatively minor changes of the order of 0.25 mm should be necessary.

Figure 10:
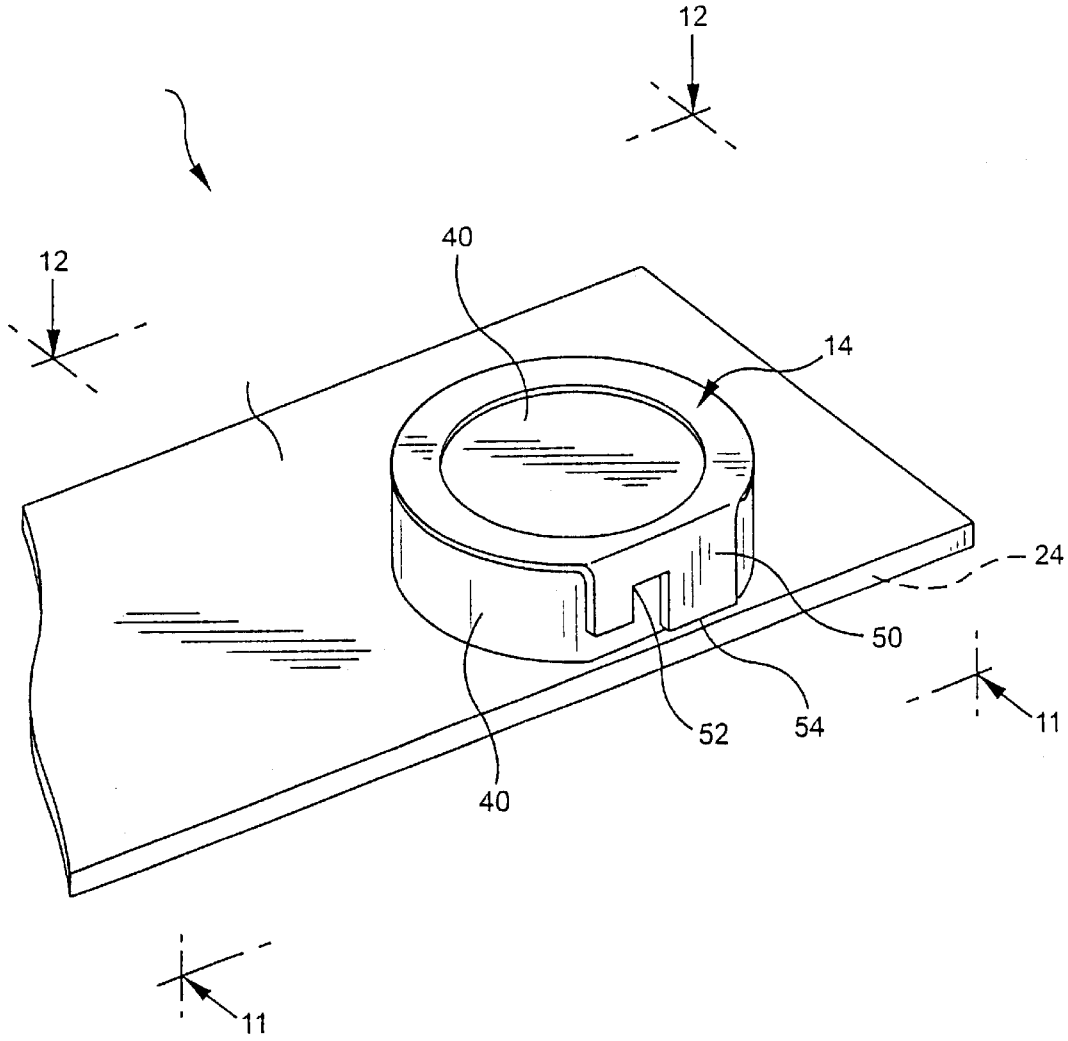
FIG. 10 is another embodiment of the loop element of the antenna assembly according to the present invention.
Figure 11:
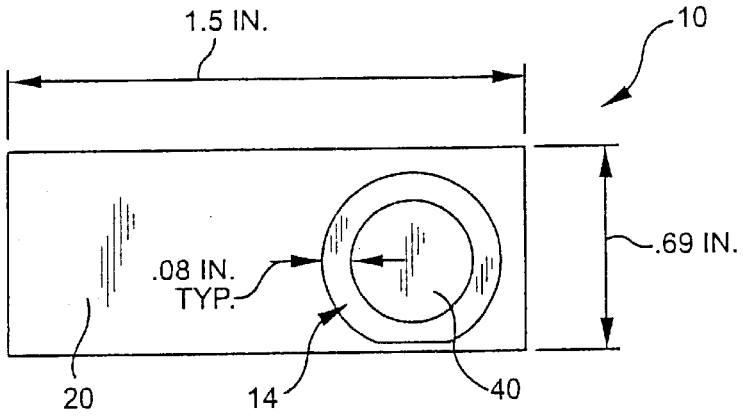
FIG. 11 is a top plan view of the antenna assembly of FIG. 10.
Figure 12:
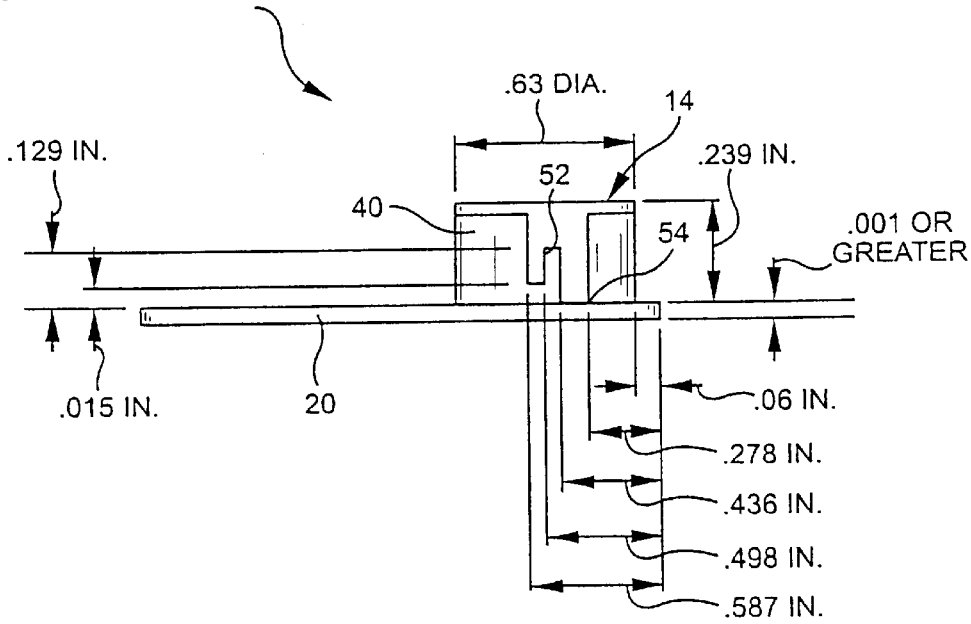
FIG. 12 is a side elevational view of the antenna assembly of FIG. 10.
Figure 13:
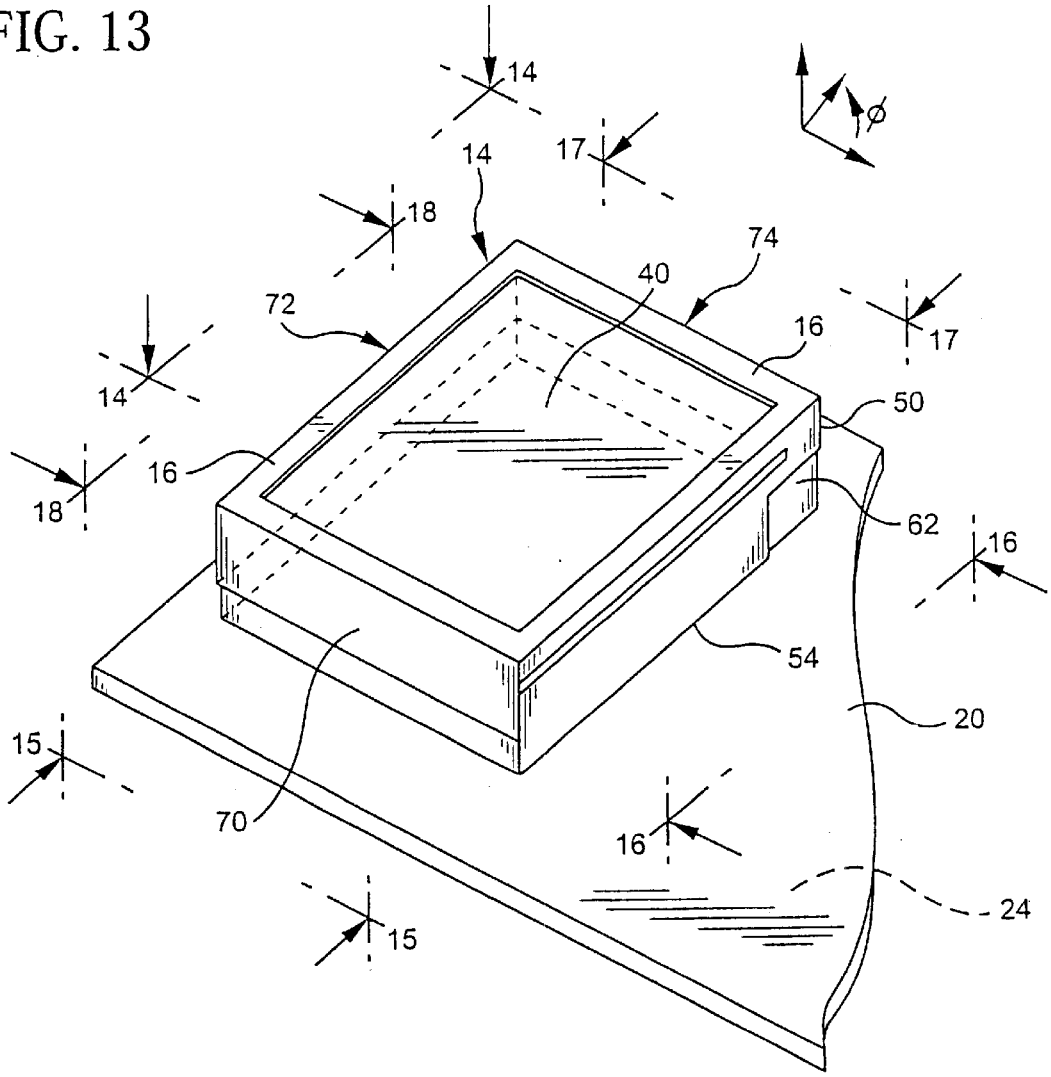
FIG. 13 is another embodiment of the loop element of the antenna assembly according to the present invention.
Figure 14:
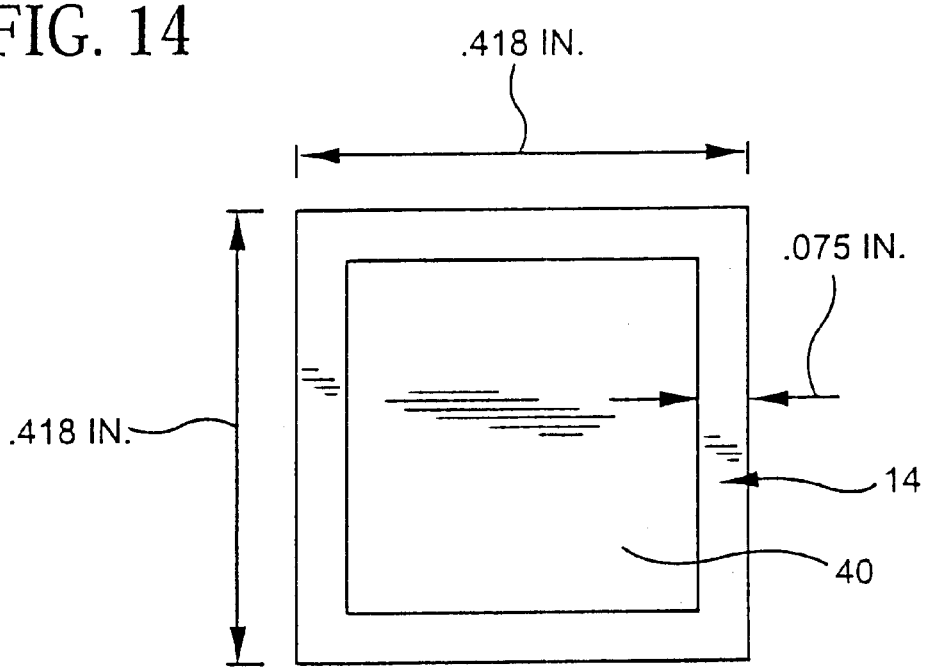
FIG. 14 is a top plan view of the embodiment of FIG. 13.
Figure 15:
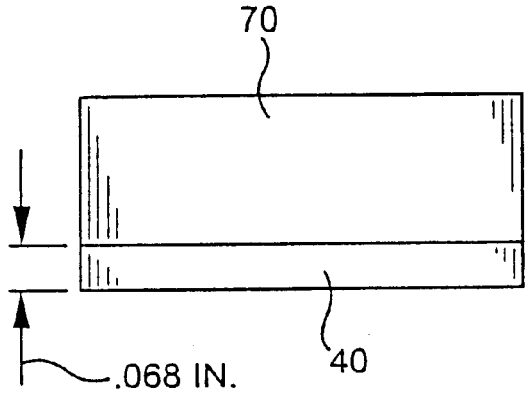
FIGS. 15–18 are side elevational views of the embodiment of FIG. 13.
Figure 16:
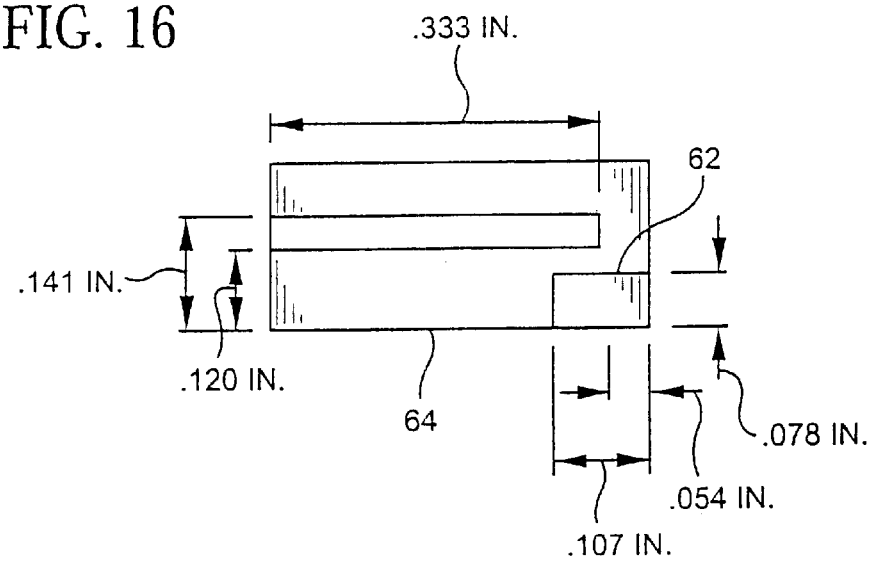
Figure 17:
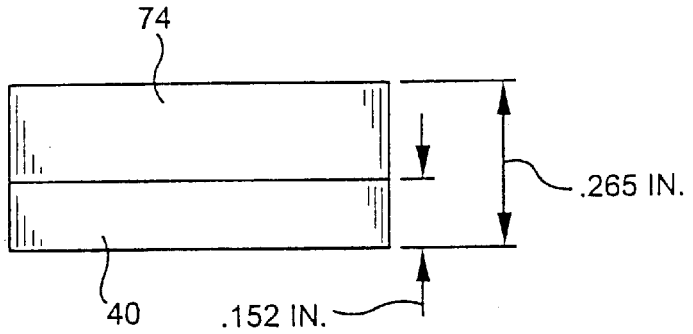
Figure 18:
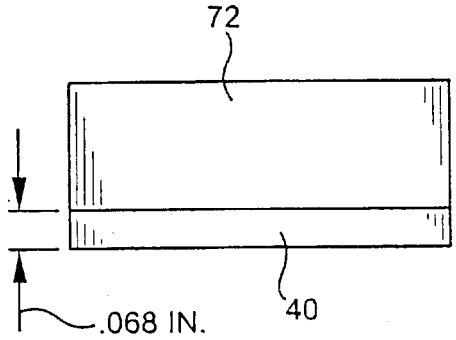

FIGS. 10–12 illustrate another embodiment of an antenna assembly 10 for a wireless communications device 10. In this embodiment, a conductive leg member 50 includes a feed point 52 defined a distance away from both the ground plane 20 of the device 12 and the ground tab 54 of the conductive leg member 50. Coupling to the device transceiver component 24 may be via a coax or other signal line.

FIGS. 13–18 illustrate yet another embodiment of an antenna assembly 10 for a wireless communications device 10. The loop resonator 14 and dielectric substrate element 40 of this embodiment are preferably rectangular in form, and yet more preferably substantially square in shape. FIGS. 14–18 provide additional views of the antenna of FIG. 13. The antenna of FIGS. 13–18 include a plurality of side conductor panels 70, 72, 74 electrically coupled to the loop resonator element 14 proximate its perimeter. In this embodiment, a conductive leg member 60 includes a feed point 62 defined a distance away from both the ground plane 20 of the device 12 and the ground tab 64 of the conductive leg member 60. As a result, a 50 ohm unbalanced electrical feed point is provided between feed point 62 and ground tab 64. Coupling to the device transceiver component 24 may be via a coax or other signal line.

Although the invention has been described in connection with particular embodiments thereof other embodiments, applications, and modifications thereof which will be obvious to those skilled in the relevant arts are included within the spirit and scope of the invention.

What is claimed is:

1. An antenna assembly for a wireless communications device operating at a predetermined wavelength and having a transceiver component including a signal output and a ground plane, said antenna assembly comprising:

a generally planar conductive closed loop element having an electrical length of approximately one half of the predetermined wavelength, said conductive closed loop element being supported in generally parallel alignment with the ground plane; and a conductive leg member having an upper end and a lower end, said upper end being coupled to the loop element, and said lower end being coupled to the ground plane and to the signal output wherein the lower end of the conductive leg member is bifurcated into a pair of separated portions, including a ground portion and a signal portion, and wherein the pair of separated portions have unequal widths.

2. The antenna assembly according to claim 1, wherein the conductive leg member is generally planar and includes a feed tab at the feed point location and a grounding tab at the ground connection location.

3. The antenna assembly according to claim 1, wherein the conductive loop element and the conductive leg member are integrally formed from a single metal part.

4. The antenna assembly according to claim 1, further comprising:

a dielectric element disposed between the loop element and the ground plane.

5. The antenna assembly according to claim 4, wherein the dielectric element is in contact with the loop element.

6. The antenna assembly according to claim 4, wherein the dielectric element has a dielectric constant of between 1 and 30.

7. The antenna assembly according to claim 1, wherein the leg member is generally perpendicular to the conductive closed loop element.

8. The antenna assembly according to claim 1, wherein the lower end of the conductive leg member is bifurcated into a pair of separated ends, and said lower end is coupled at one of the pair of separated ends to the ground plane and at the other of the pair of separated ends to the signal output.

9. An antenna assembly for a wireless communications device operating at a predetermined wavelength and having a transceiver circuit including a signal output and a ground plane, said antenna assembly comprising:

a generally planar conductive closed loop element having an electrical length of approximately one half of the predetermined wavelength, said conductive closed loop element being supported in substantially parallel alignment with the ground plane; and a conductive leg member having an upper end and a lower end, said upper end being coupled to the closed loop element, wherein said lower end is coupled to the ground plane and to the signal output of the wireless communications device wherein the lower end of the conductive leg member is bifurcated into a pair of separated portions, including a ground portion and a signal portion, and wherein the pair of separated portions have unequal widths.

10. The antenna assembly according to claim 9, wherein the conductive leg member is generally planar and includes a feed tab at the feed point location and a grounding tab at the ground connection location.

11. The antenna assembly according to claim 9, wherein the conductive loop element and the conductive leg member are integrally formed from a single metal part.

12. The antenna assembly according to claim 9, further comprising:

a dielectric element disposed between the loop element and the ground plane.

13. The antenna assembly according to claim 12, wherein the dielectric element is in contact with the loop element.

14. The antenna assembly of claim 9, wherein the loop element is disposed on a side of a printed wiring board which faces away from a user during intended operation of the wireless communications device.

15. The antenna assembly according to claim 9, wherein the leg member is generally perpendicular to the conductive closed loop element.

16. The antenna assembly according to claim 9, wherein the lower end of the conductive leg member is bifurcated into a pair of separated ends, wherein said lower end is coupled at one of the pair of separated ends to the ground plane and at the other of the pair of separated ends to the signal output of the wireless communications device.

17. A wireless communications device comprising:

a printed wiring board having a ground plane element;

an electronic signal transceiving component coupled to the printed wiring board and having a signal output;

a generally planar conductive closed loop element having an electrical length of approximately one half of a predetermined operational wavelength, said conductive closed loop element being maintained in substantially parallel alignment with the ground plane; and a conductive leg member having an upper end and a lower end, said upper end being coupled to the loop element, and said lower end being coupled to the ground plane and to the signal output wherein the lower end of the conductive leg member is bifurcated into a pair of separated portions, including a ground portion and a signal portion, and wherein the pair of separated portions have unequal widths.

18. The wireless communications device of claim 17, further comprising:

a dielectric element disposed between the loop element and the ground plane.

19. The wireless communications device of claim 18, wherein the dielectric element is in contact with the loop element.

20. The antenna assembly according to claim 18, wherein the dielectric element has a dielectric constant of between 1 and 30.

21. The wireless communications device of claim 17, wherein the loop element is disposed on a side of the printed wiring board which faces away from a user during intended operation of the wireless communications device.

22. The antenna assembly according to claim 17, wherein the leg member is generally perpendicular to the conductive closed loop element.

23. The antenna assembly according to claim 17, wherein the lower end of the conductive leg member is bifurcated into a pair of separated ends, and said lower end is coupled at one of the pair of separated ends to the ground plane and at the other of the pair of separated ends to the signal output.

* * * * *